US007699253B2

(12) United States Patent
Niklewski

(10) Patent No.: US 7,699,253 B2
(45) Date of Patent: Apr. 20, 2010

(54) CONICAL CRUSHER

(75) Inventor: Andrzej Niklewski, Sao Paulo (BR)

(73) Assignee: Metso Brasil Ind. E Com. Ltda., Sorocaba (BR)

( * ) Notice: Subject to any disclaimer, the term of this patent is extended or adjusted under 35 U.S.C. 154(b) by 0 days.

(21) Appl. No.: 11/817,810

(22) PCT Filed: Oct. 11, 2006

(86) PCT No.: PCT/BR2006/000213

§ 371 (c)(1),
(2), (4) Date: Oct. 16, 2007

(87) PCT Pub. No.: WO2007/041819

PCT Pub. Date: Apr. 19, 2007

(65) Prior Publication Data

US 2008/0272218 A1 Nov. 6, 2008

(30) Foreign Application Priority Data

Oct. 13, 2005 (BR) ..... 0504725

(51) Int. Cl.
*B02C 2/00* (2006.01)

(52) U.S. Cl. ..... 241/207

(58) Field of Classification Search ..... 241/207–216
See application file for complete search history.

(56) References Cited

U.S. PATENT DOCUMENTS 3,384,312 A * 5/1968 Patterson et al. ..... 241/208
4,478,373 A 10/1984 Gieschen
4,892,257 A * 1/1990 Stoeckmann et al. ..... 241/32

FOREIGN PATENT DOCUMENTS

DE 2243312 3/1974
GB 1397701 6/1975

* cited by examiner

*Primary Examiner*—Mark Rosenbaum
(74) *Attorney, Agent, or Firm*—Darby & Darby P.C.

(57) ABSTRACT

A conical crusher, comprising: an upper housing; a tubular axle lodging a supporting rod. Inside the upper housing is mounted a cone head being axially journalled onto a spherical bearing carried by an upper end of the supporting rod and said cone head being radially and eccentrically journalled around the tubular axle. The supporting rod has a lower end thereof fixed to a piston of a hydraulic cylinder in order to operate as a support means for the cone head and also as an actuator to vertically displace the cone head and adjust the opening of the crushing cavity and also as a protecting means, reducing the hydraulic pressure to prevent overloads. The proposed solution further provides a locking hub mechanism in the cone head.

10 Claims, 4 Drawing Sheets

CONICAL CRUSHER

CROSS REFERENCE TO PRIOR APPLICATION

This application is the U.S. national phase of International Application No. PCT/BR2006/000213, filed Oct. 11, 2006, which claims priority from Brazilian Patent Application No. PI0504725-0, filed Oct. 13, 2005, the disclosure of both are incorporated herein by reference in their entirety.

FIELD OF THE INVENTION

The present invention refers, in general terms, to a conical crusher of the type comprising an upper housing in which interior operates a cone head driven in an eccentric oscillating motion around a fixed vertical tubular axle, said cone head being axially journalled at the upper end of a supporting rod located inside the tubular axle and which is axially and selectively displaceable in order to vary the opening of a crushing cavity defined between the cone head and the upper housing.

The invention is particularly related to the means responsible for bearing and adjusting the position of the cone head in relation to the upper housing.

PRIOR ART

Different constructive solutions are known for supporting the cone head of a crusher of the type considered herein.

One of the known solutions may be found schematically illustrated in FIG. 1 of the attached drawings, in which is represented a conical crusher comprising a structure 10 in which is superiorly mounted an upper housing 20 and inferiorly fixed a lower end 31 of a vertically disposed tubular axle 30 which carries, in an upper end 32 thereof, a spherical bearing 50. A cone head 70 is mounted inside the upper housing 20 to form, with the latter, a crushing cavity CB. The cone head 70 *é* provided with a spherical end 71, which is seated and journalled on the spherical bearing 50, said cone head 70 further having its inner lower region radially journalled around a tubular eccentric 80, which is rotatively mounted around a tubular axle 30. The radial bearing of the cone head 70 made with the aid of tubular bushings, one being an internal bushing 81 located between the tubular axle 30 and the tubular eccentric 80, and the other an external bushing 82, located between the tubular eccentric 80 and the cone head 70.

The tubular eccentric 80 is axially and inferiorly seated on the structure 10 of the conical crusher by a set of axial bearings 83, said tubular eccentric 80 being provided with a ring gear 84 which is geared to a pinion 91 of a drive mechanism 90, suitably mounted on structure 10 and which will not be described in detail since it does not make part of the present invention. The rotation drive of the tubular eccentric 80 by the driving mechanism 90 causes the oscillation of the cone head 70 around the fixed tubular axle 30, providing the crushing of the material inside the crushing cavity "CB".

Inside the tubular axle 30 is mounted a supporting rod 40, having an upper end 41 which projects outward from the tubular axle 30 to receive a spherical bearing 50 onto which is seated the spherical end 71 of the cone head 70.

The supporting rod 40 presents a lower end 42 projecting beyond the lower end of the tubular axle 30 and to which is coupled an actuator, generally in the form of a piston 60, located inside a hydraulic cylinder 11 formed in the lower portion of the structure 10 of the conical crusher, said hydraulic cylinder 11 defining, with piston 60, a hydraulic ram dimensioned to allow, when driven, the vertical axial displacement of the supporting rod 40, in order to provide the axial displacement of the cone head 70 to different operational positions, adjusting the opening of the crushing cavity "CB".

Although not illustrated herein for not making part of the present invention, it should be understood that the hydraulic cylinder 11 may be coupled to a pressure limiting valve or to a hydraulic accumulator, to function as a protection device against overloads in the crushing cavity "CB", allowing the descending displacement of the cone head 70, increasing the distance from the upper housing 20 and increasing the opening of the crushing cavity "CB" to automatically reduce the crushing overload when the adjustment hydraulic system detects said overload.

The setting of the opening of the crushing cavity "CB" is carried out by the vertical displacement of the cone head 70 by axial displacement of the supporting rod 40.

The rigid mounting of the supporting rod 40 in the construction of FIG. 1 does not allow radial oscillations of the supporting rod 40 and of the spherical bearing 50 that supports the axial loads of the cone head 70.

Considering that the supporting rod 40 is fixed in the radial direction, the spherical bearing 50 that supports the cone head 70 is subject to high oscillatory amplitudes during the crusher operation. Although said axial bearing of the cone head 70 is made with provision of oil in the spherical bearing 50, the relatively low rotation speed of the conical crushers does not allow the formation of a hydrodynamic wedge in the axial bearing. The loads to which the axial bearing 50 is subjected as a function of the radially fixed mounting of the supporting rod 40, together with the difficulty in forming a hydrodynamic wedge in the axial bearing of the cone head 70, allows the occurrence of metal-metal contact, with the consequent loss of power caused by friction and of lifespan of the bearing itself, reducing the intervals between equipment stop for replacing wear parts. These known solutions thus present the inconvenient of subjecting the axial bearing 50 to excessive loads, which tend to cause an accelerated wear of said component, due to the difficulty in obtaining an adequate lubrication by the simple supply of oil to the bearing.

Another inconvenient of the known solutions refers to the fact that the cone head is not prevented from rotating in the same direction of the tubular eccentric, when the conical crusher operates with zero load. In this condition, the cone head tends to be rotatively dragged by the spin of the tubular eccentric, gaining speed and being subjected to a sudden and wearing braking upon the restart of material feeding into the crushing cavity "CB".

SUMMARY OF THE INVENTION

Due to the drawbacks mentioned above and related to the prior art solution, it is an objective of the present invention to provide a conical crusher of the type illustrated in FIG. 1 and described above and which has the axial bearing that supports the cone head subjected to very reduced and even practically nonexistent oscillation amplitudes, facilitating the lubrication and increasing the lifespan of the axial bearing components of the cone head.

It is a further objective of the present invention to provide a conical crusher as mentioned above, which presents a lubrication that provides the formation of a hydrostatic support in the axial bearing of the cone head, in order to prevent the metal-metal contact, thereby increasing the lifespan of the bearing components and allowing the latter to present smaller dimensions.

It is also a further objective of the present invention to provide a conical crusher as mentioned above, whose cone head is prevented from rotating around its axial axis, in the same direction of rotation of the tubular eccentric.

According to the present invention, the conical crusher comprising the elements considered in the construction illustrated in FIG. 1, has the supporting rod with the upper end thereof articulated to the cone head and the lower end thereof provided with a spherical joint with the structure, said supporting rod defining, with the axial through hole of the tubular axle, a radial gap sufficient for allowing the oscillation of the supporting rod around the spherical joint, following the oscillation of the cone head during operation of the conical crusher, said radial gap being slightly larger than the eccentricity of the radial bearing of the cone head, in order to avoid that the supporting rod touches the tubular axle.

BRIEF DESCRIPTION OF THE DRAWINGS

The invention will be described below with reference being made to the attached drawings, given by way of example of constructions for a conical crusher and in which.

DETAILED DESCRIPTION OF THE INVENTION

Figure 1:
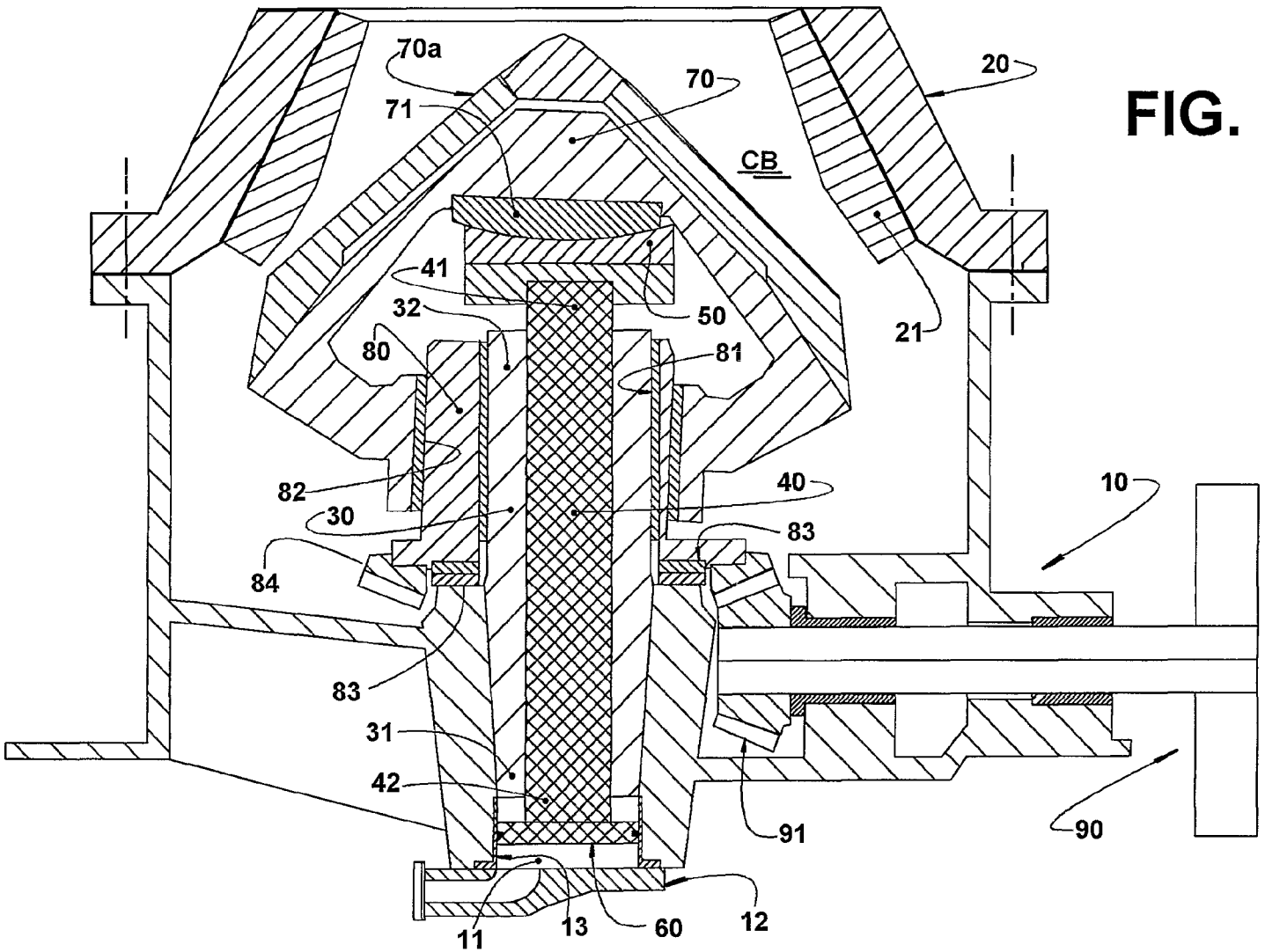
FIG. 1 represents a schematic and simplified vertical sectional view of a prior art conical crusher, of the type in which the crushing cavity opening is adjusted by the axial displacement of the cone head.

As already mentioned, the invention is applied to a conical crusher of the type illustrated in FIG. 1 and comprising a structure 10 in which is superiorly adapted an upper housing 20 built by any manner well known in the art, said upper housing 20 being internally provided with a lining 21 of a material adequate to withstand the crushing loads to which it is subjected.

Figure 2:
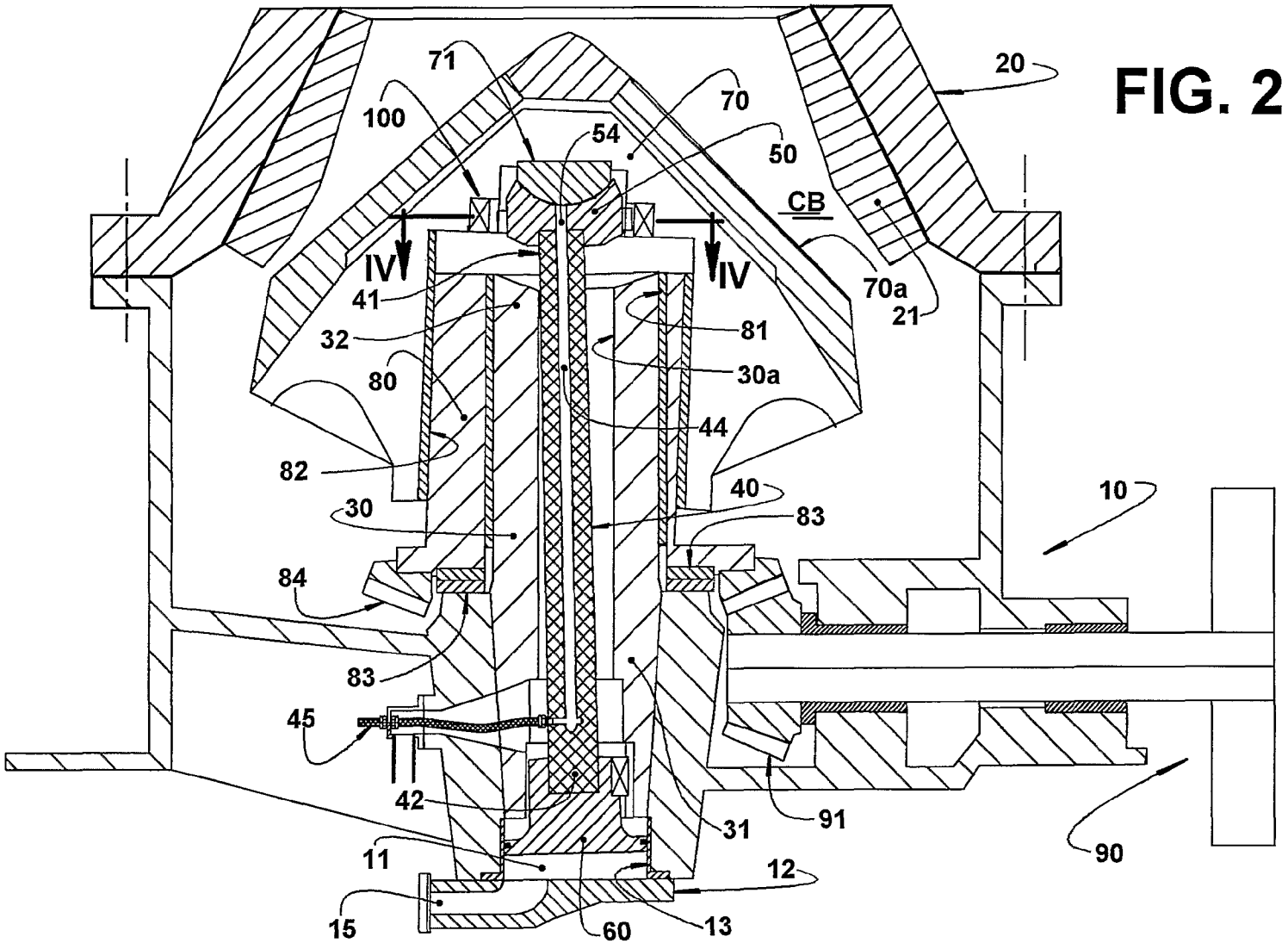
FIG. 2 represents a schematic and simplified vertical sectional view of a conical crusher built according to the present invention.

As illustrated in FIG. 2, the present crusher further comprises a vertically disposed tubular axle 30, having an axial through hole 30*a* and a lower end 31 fixed to the structure 10 and open to an upper end of a hydraulic cylinder 11, which is inferiorly formed in the structure 10 and has a lower end closed by a cover 12. The tubular axle 30 presents an upper end 32.

The hydraulic cylinder 11 has a lateral wall 13*a* generally defined by a removable cylindrical sleeve 13, internally lining said hydraulic cylinder 11. Inside the tubular axle 30 is provided a supporting rod 40 that has an upper end 41 carrying a spherical bearing 50 and a lower end 42 carrying a piston 60, which is selectively and axially displaceable inside the hydraulic cylinder 11, producing a corresponding vertical displacement in the supporting rod 40 and in the spherical bearing 50, as described further below. Inside the upper housing 20 is provided a cone head 70 provided with a lining 70*a* and which forms, with the upper housing 20, a crushing cavity "CB", the cone head 70 being internally and superiorly provided with a spherical end 71, to be seated onto the spherical bearing 50, and further being radially and inferiorly journalled, with an external bushing 82, around a tubular eccentric 80 which, in turn, is rotatively mounted around the tubular axle 30 with the placement of an inner tubular bushing 81 between the tubular axle 30 and the tubular eccentric 80. It should be understood that the axial bearing of the cone head 70 onto the upper end 41 of the supporting rod 40 may be obtained by assemblies other than that illustrated herein by way of example.

The tubular eccentric 80 is provided with a ring gear 84 geared to a pinion 91 of a drive mechanism 90 mounted on structure 10, as already mentioned in relation to the structure illustrated in FIGS. 1 and 2, said tubular eccentric 80 being inferiorly and axially journalled in structure 10 by means of a set of axial bearings 83 of any adequate construction. According to the invention, the supporting rod 40 presents an external contour of the cross-section smaller than the contour of the cross-section of the axial through hole 30*a* of the tubular axle 30, in order to oscillate inside said axial through hole 30*a* without touching its walls during the oscillation motion of the cone head 70 in operation and by action of the tubular eccentric 80.

In order that the supporting rod 40 may oscillate, following the oscillation of the cone head 70, the first has its upper end 41 articulated to the cone head 70 by means of the spherical end 71 of the latter and the spherical bearing 50, and with the lower end 42 being articulated to the structure 10 by means of the piston 60.

Figure 3:
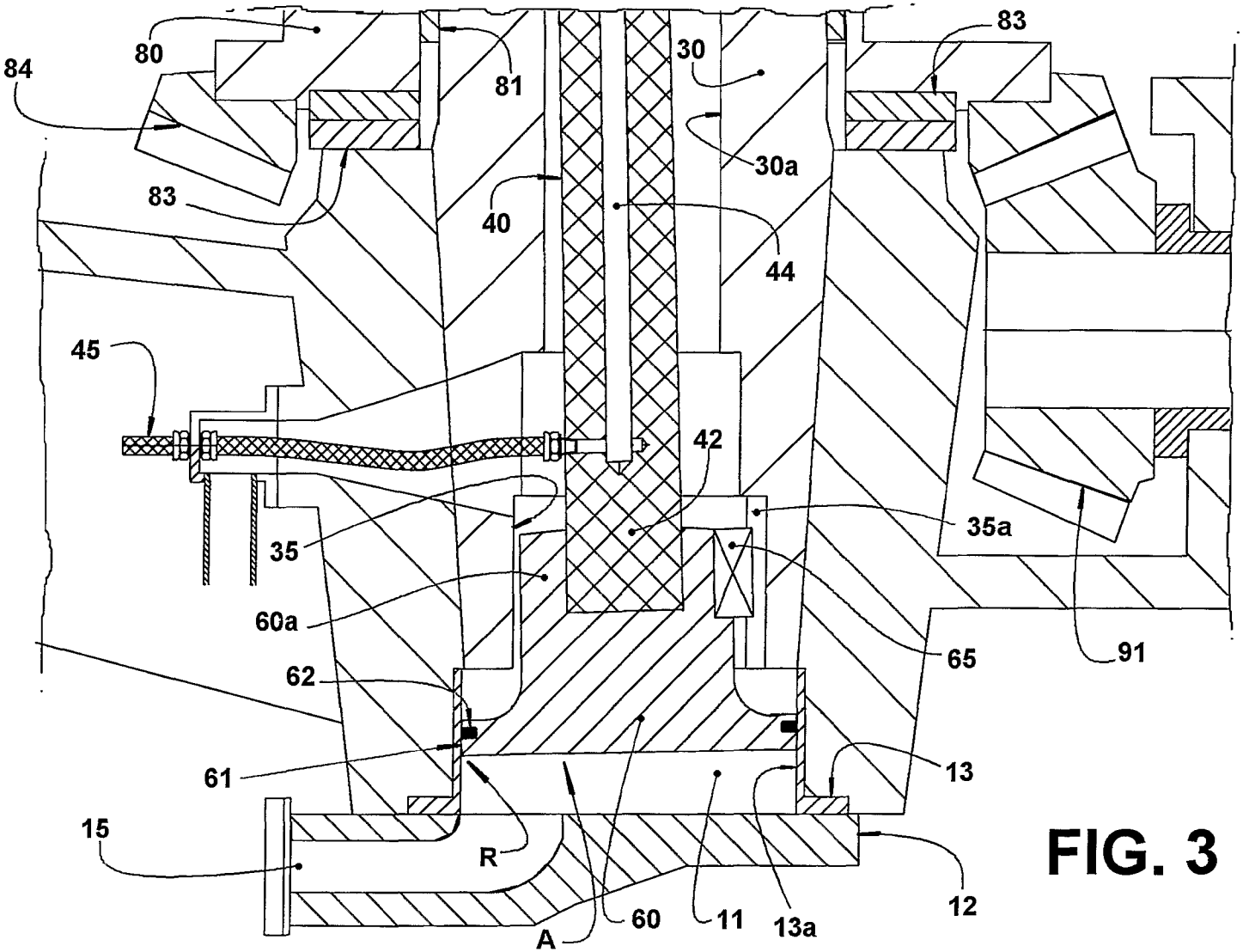
FIG. 3 represents an enlarged detail of FIG. 2, illustrating the construction of the lower end of the supporting rod and piston.
Figure 3A:
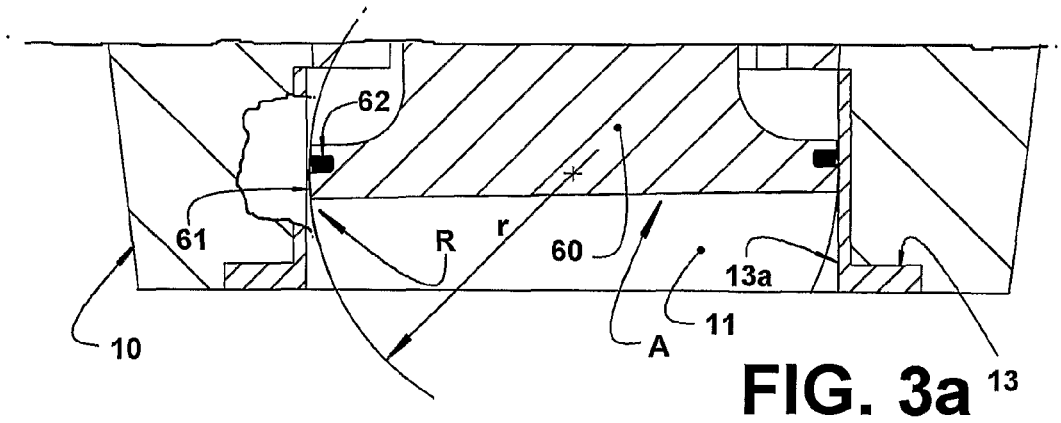
FIG. 3*a* represents an enlarged detail illustrating the formation of the spherical joint "R" between the lateral walls of the piston and of the hydraulic cylinder.

In the construction illustrated in FIGS. 2, 3 and 3*a*, the lower end 42 of the supporting rod 40 is rigidly fixed to the piston 60, whereby the articulation of said lower end 42 to the structure 10 is carried out providing piston 60 with a surrounding lateral wall 61 whose section is on the form of an externally convex circular arc, which cooperates with the lateral wall 13*a* of the cylindrical sleeve 13 of the hydraulic cylinder 11 to define, with said sleeve, a preferably hydraulic actuator "A", and also a spherical joint "R".

The crushing force resulting from the oscillating motion of the cone head 70 is transmitted, through the rod 40, to the piston 60, and is supported by the oil pressure generated in the hydraulic cylinder 11. The rod 40, following the cone head 70 motion, induces a slight oscillatory motion on piston 60. The outer edge of piston 60, where is inserted a sealing 62, has a spherical shape, allowing a vertical displacement during piston oscillation, without interfering with the lateral wall 13*a* of the cylindrical sleeve 13 of the hydraulic cylinder 11. Another possible construction would be to provide an articulated coupling between the lower end 42 of the supporting rod 40 and the piston 60, the latter in this case having a cylindrical lateral wall 61 cooperating with the lateral wall 13*a* of the hydraulic cylinder 11.

As better illustrated in FIGS. 3 and 3*a*, the lateral wall 61 of piston 60 may carry a sealing ring 62 to act against the lateral wall 13*a* of the cylindrical sleeve 13 of the hydraulic cylinder 11, in any operational position of the supporting rod 40 within the oscillation amplitude to which it is subjected, by the motion of the spherical bearing 50 when conducted by the motion of the cone head 70 due to the rotation of the tubular eccentric 80.

In this type of construction, in which the vertical motion of the supporting rod 40 is effected by the piston 60, the hydraulic cylinder 11 is hydraulically pressurized from a source of pressurized fluid (not illustrated) which is in communication with the interior of the hydraulic cylinder 11 below piston 60 through a nozzle 15 which may be provided in the cover 12. As mentioned before in relation to the prior art, piston 60 operates hydraulically, not only as the vertical thrusting element of the supporting rod 40, but also as a safety device against overloads. The source of pressurized fluid and the hydraulic cylinder 11 may be associated with a pressure limiting valve or to a hydraulic accumulator (not illustrated and of known existence and function) to release hydraulic fluid, allowing the descent of the cone head 70 and the opening of the crushing cavity "CB" upon the occurrence of an overload condition.

The piston 60 presents an axial extension 60*a*, in which is rotatively, axially and angularly fixed the lower end 42 of the supporting rod 40, said axial extension 60*a* being positioned inside an enlarged lower end 35 of the axial through hole 30*a* of the tubular axle 30, said enlarged lower end 35 being provided with at least one longitudinal cutout 35*a*, in which runs a key 65 radially fitted in the axial extension 60*a* of piston 60, locking any rotation of the latter in relation to the tubular axle 30 and, consequently, also in relation to the structure 10, yet allowing piston 60 to oscillate together with the supporting rod 40.

It should be noted herein that the oscillation of the supporting rod 40 around the spherical joint "R", defined herein by both the lateral wall 61 of piston 60 and the lateral wall 13*a* of the cylindrical sleeve 13 of the hydraulic cylinder 11, due to the geometry of the conical crusher, is limited to very reduced values which are defined by the eccentricity of the tubular eccentric 80, with the radial gap between the supporting rod 40 and the tubular axle 30 having to be dimensioned slightly larger than said oscillation eccentricity of the cone head 70 and of the spherical bearing 50, in order to avoid that the supporting rod 40, particularly the upper region thereof, touches the tubular axle 30.

As mentioned before in relation to FIG. 1, piston 60 should be understood as a possible constructive form for an actuator "A" mounted on structure 10, in order to be selectively driven to axially displace the supporting rod 40 and the cone head 70. In case the actuator "A" is not hydraulic, piston 60 may be replaced or take the form of a lower rod terminal, built so as to define a spherical joint "R" with structure 10 or with the lower end 42 itself of the supporting rod 40, keeping the latter rotatively locked in relation to both the tubular axle 30 and the structure 10.

The construction proposed by the present invention to provide the oscillation of the supporting rod 40, allowing it to follow the oscillation of both the cone head 70 and the spherical bearing 50, leads to a substantial reduction of the articulation motion in the region of the spherical bearing 50, said reduction of motion achieving an order of about 6 times less than that found in the present axial spherical bearings mounted on radially fixed supporting rods. The reduction in relative motion at the spherical bearing 50 reduces its wear, allowing the use of the conventional lubrication of the prior art.

However, the lubrication of the spherical bearing 50 may be carried out in order to provide a hydrostatic support for the cone head 70. In this case, the supporting rod 40 is provided with a central axial channel 44 having a lower connected, usually by means of a flexible hose 45, to a source of high-pressure pressurized lubricating oil (not illustrated) and an upper end connected to at least one radial channel 54 of the spherical bearing 50. The lubricating oil at high-pressure is forced, through the central axial channel 44 and radial channel 54, toward the face of the spherical bearing 50, onto which is seated spherical end 71 of the cone head 70, defining a hydrostatic support between the spherical end 71 and spherical bearing 50, preventing the direct contact between the two components of the axial journal of the cone head 70.

Besides the journaling and lubrication aspects mentioned above, the invention also addresses the problem created when the cone head is left to rotate together with the tubular eccentric 80, being dragged by the latter in the same rotation direction, when the crushing cavity "CB" is not being fed with material to be crushed (zero load operation). In this condition, when the material is fed to the crushing cavity "CB", the cone head 70 is stops suddenly. The high inertial forces of the cone head 70 causes, with the sudden stop, an undesirable wear of the linings of the crushing cavity "CB".

With the purpose of eliminating this drawback, the present invention provides a locking hub mechanism 100 mounted inside the cone head 70 which is operatively coupled to the spherical bearing 50, to allow the usual slow rotation of the cone head 70 in the opposite direction of rotation of the tubular eccentric 80 upon the crushing operation of a load of material continuously fed to the crushing cavity "CB", but preventing the cone head 70 from rotating in the same rotation direction of the tubular eccentric 80. Thus, when operating with zero load, the cone head 70 is prevented from being rotationally dragged by the rotation of the tubular eccentric 80, remaining rotationally stationary and waiting for the restart of the feeding of material to be crushed to then start, without any sudden stops, its slow rotation in the opposite direction of rotation of the tubular eccentric 80.

Figure 4:
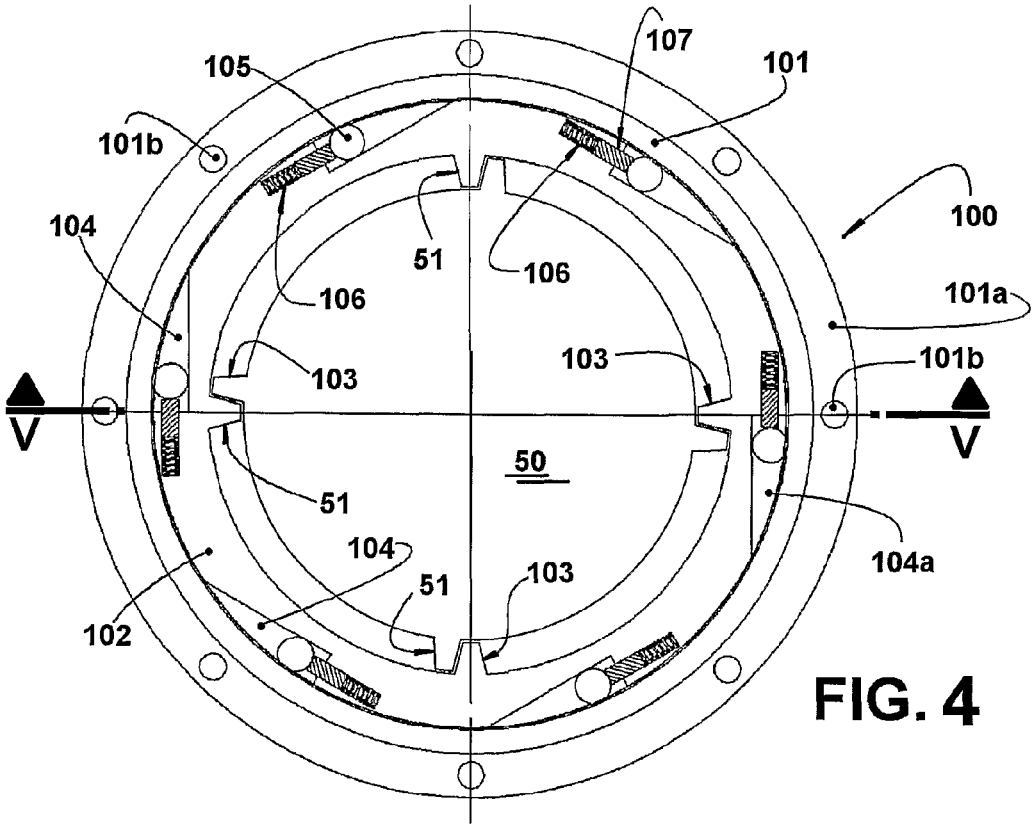
FIG. 4 represents a horizontal sectional view of the axial bearing region of the cone head, taken along line IV-IV in FIG. 2 and illustrating the locking hub device.
Figure 5:
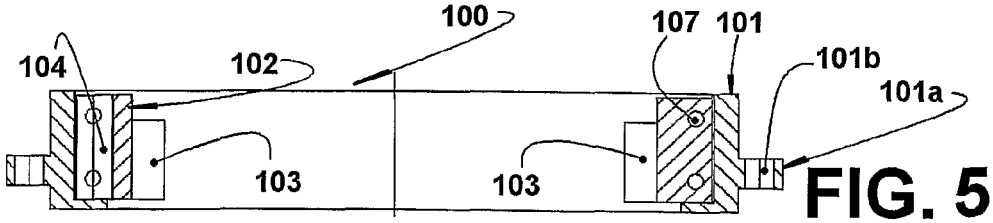
FIG. 5 represents a diametral sectional view of the locking hub device, taken along line V-V in FIG. 4, but with the spherical bearing not illustrated.

The locking hub mechanism 100 is comprised, according to an exemplary form illustrated in FIGS. 4 and 5, by an outer race 101 fixed inside the cone head 70, usually by means of bolts (not illustrated) passing through holes 101*b* provided in a flange 101*a*, externally incorporated to the outer race 101, and by an inner race 102, which inner edge incorporates a plurality of radial teeth 103, which mesh with a certain angular gap with radial teeth 51 externally incorporated to the spherical bearing 50, in order to prevent the free rotation of the inner race 102 in relation to the spherical bearing 50.

The locking hub device 100, in the illustrated example, further presents rotation blocking means defined by a plurality of cutouts 104 formed on the outer edge of the inner race 102 and having a variable depth defined by a tapered wall 104*a*, with each of the cutouts 104 lodging a roller 105 which remains simultaneously seated, like a wedge, onto the inner edge of the outer race 101 and on the tapered wall 104*a* of the respective cutout 104. Each roller 105 is constantly and elastically forced, by a set of spring 106 and rod 107, to the shallowest region of the cutout 104, turned to the direction of rotation of the tubular eccentric 80.

With this construction, when the crusher is operating with zero load, the tubular eccentric tends to rotate the cone head 70 and the inner race 102 of the locking hub mechanism in the same direction, forcing the rollers 105 to the shallowest region of the cutouts 104, locking the outer race 101 to the inner race 102 and preventing the rotation of the cone head 70 in this direction. In the opposite direction, the outer race 101 forces the rollers 105 toward the deepest region of the cutouts 104, against the force of the spring 106, minimizing the friction of the rollers 105 with the races and allowing the rotation of the cone head 70.

Although only one embodiment of the invention has been illustrated, it should be understood that modifications in the shape and arrangement assembly of the components may be made without departing from the constructive concept defined in the accompanying claims.

The invention claimed is:

1. A conical crusher, comprising:

a structure, superiorly carrying an upper housing;

a tubular axle vertically fixed to the structure and provided with an axial through hole housing a supporting rod having an upper end and a lower end coupled to an actuator mounted on structure;

a cone head internal to the upper housing and defining therewith a crushing cavity, said cone head being axially journalled onto the upper end of the supporting rod and being radially and eccentrically journalled around the tubular axle, said actuator being selectively driven to define the axial positioning of the supporting rod and of the cone head in relation to the upper housing, wherein the supporting rod has the upper end thereof articulated to the cone head and the lower end thereof provided with a spherical joint formed in the structure, said supporting rod defining, with the axial through hole of the tubular axle, a radial gap sufficient for allowing the oscillation of the supporting rod around the spherical joint, following the oscillation of the cone head during operation of the conical crusher, said radial gap being slightly larger than the eccentricity of the radial bearing of the cone head, in order to prevent the supporting rod from touching the tubular axle.

2. Conical crusher, according to claim 1, wherein the structure comprises a hydraulic cylinder having a lateral wall, with the actuator being defined by a piston coupled to the lower end of the supporting rod and having a lateral wall to be axially displaced, by hydraulic pressure, inside the hydraulic cylinder, cooperating with the lateral wall of the latter, wherein the spherical joint is formed by the cooperation of one of the pair of the piston and the supporting rod or the piston and the hydraulic cylinder.

3. Conical crusher, according to claim 2, wherein the spherical joint is defined by the lateral wall of the piston, which presents a section in the form of an externally convex circular arc, cooperating with the lateral wall of the hydraulic cylinder.

4. Conical crusher, according to claim 3, wherein the lateral wall of the piston carries a sealing ring acting against the lateral wall of the hydraulic cylinder.

5. Conical crusher, according to claim 3, wherein the lower end of the supporting rod is rotatively, axially and angularly fixed to piston, the latter being rotatively locked in relation to the tubular axle.

6. Conical crusher, according to claim 5, wherein the piston presents an axial extension which is rotatively locked, by means of a key, to a longitudinal slot provided in an enlarged lower end of the axial though hole of the tubular axle.

7. Conical crusher, according to claim 1, wherein the upper end of the supporting rod secures a spherical bearing, the cone head being provided with a spherical end axially journalled onto the spherical bearing, the supporting rod being provided with a central axial channel having a lower end connected to a source of high-pressure pressurized lubricating oil and an upper end connected to at least one radial channel of the spherical bearing, in order to be forced to the face of the latter, onto which is seated the spherical end of the cone head, defining a hydrostatic support for the latter.

8. Conical crusher, according to claim 1, in which the cone head radially journalled around a tubular eccentric rotatively mounted around the tubular axle, wherein the supporting rod is rotatively locked in relation to the tubular axle, to the structure, with a locking hub mechanism being mounted inside the cone head and operatively coupled to the upper end of the supporting rod, in order to allow the slow rotation of the cone head in the opposite direction of rotation of the tubular eccentric upon operation under load of the conical crusher and to prevent the cone head from rotating in the same rotation direction of the tubular eccentric.

9. Conical crusher, according to claim 8, wherein the locking hub mechanism comprises an outer race internally fixed in the cone head and an inner race rotatively locked around the upper end of the supporting rod and provided with rotation blocking means defined by a plurality of cutouts of variable height and defined by a tapered wall, each of the cutouts housing a roller seated on the inner edge of the outer race and on the tapered wall of the respective cutout and also being constantly and elastically biased by a spring toward the most shallowest portion of the cutout.

10. Conical crusher, according to claim 9, wherein the upper end of the supporting rod secures a spherical bearing, the cone head being provided with a spherical end axially journalled onto the spherical bearing, with the inner race of the locking hub mechanism being rotatively locked around the spherical bearing.

* * * * *